US005224318A

United States Patent [19]

Kemerer

[11] Patent Number: 5,224,318

[45] Date of Patent: Jul. 6, 1993

[54] MOLDED PROTECTIVE EXTERIOR WEATHER-RESISTANT BUILDING PANELS

[76] Inventor: W. James Kemerer, 25711 Morales, Mission Viejo, Calif. 92691

[21] Appl. No.: 657,853

[22] Filed: Feb. 19, 1991

[51] Int. Cl.[5] ..... E04D 1/34

[52] U.S. Cl. ..... 52/521; 52/520; 52/536; 52/539; 52/546; 52/555

[58] Field of Search ..... 52/520, 521, 522, 523, 52/525, 535, 536, 539, 542, 546, 555, 309.14

[56] References Cited

U.S. PATENT DOCUMENTS

| | | | |
|---|---|---|---|
| 2,735,143 | 2/1956 | Kearns | 52/521 |
| 2,739,676 | 3/1956 | Tomita | 52/521 |
| 3,217,453 | 11/1965 | Meadow | 52/539 |
| 3,325,952 | 6/1967 | Trachtenberg | 52/521 |
| 3,458,962 | 8/1969 | Kendall | 52/521 |
| 3,504,467 | 4/1970 | Hatch et al. | 52/521 |
| 3,520,099 | 7/1970 | Mattes | 52/521 |
| 3,703,795 | 11/1972 | Mattes | 52/521 |
| 3,783,570 | 1/1974 | Storch | 52/553 |
| 3,862,532 | 1/1975 | Markos | 52/553 X |
| 4,435,933 | 3/1984 | Krowl | 52/521 X |
| 4,435,938 | 3/1984 | Rutkowski | 52/521 |
| 4,450,665 | 5/1984 | Katz | 52/546 X |
| 4,680,911 | 7/1987 | Davis et al. | 52/521 |
| 5,050,357 | 9/1991 | Lawson | 52/520 X |
| 5,072,562 | 12/1991 | Crick et al. | 52/521 X |
| 5,076,037 | 12/1991 | Crick et al. | 52/520 |

*Primary Examiner*—Carl D. Friedman
*Assistant Examiner*—Robert Canfield
*Attorney, Agent, or Firm*—Parmelee, Bollinger & Bramblett

[57] ABSTRACT

Molded exterior building panels formed from thermoplastic material and method of making and installing such panels in aligned relationship on building structures An upper margin of a building panel includes nail slots for fastening to a building An upwardly projecting lip along the top defines an engageable mounting groove behind this lip. A horizontally extending mounting hook on the back of a lower margin of each panel provides for hooking engagement with lip and groove of a next lower installed panel. During installation such hooking engagement advantageously supports the weight of a panel being installed and automatically provides alignment of the panel with the next lower installed panel, thereby freeing an installer from the burden of holding a panel in a desired position at a desired level while driving nails through the nail slots. Panels are molded from thermoplastic material with surface textures and patterns for simulating courses of attractive building surfacing products, such as clapboards, shingles, shakes and slates. Front and back lap-joint channels are routed along panel ends. The mounting hook is formed by heating, bending down and then setting a rear edge of a horizontally-extending, rearwardly-projecting ledge strip. Elongated nail slots accommodate thermal expansion and contraction of installed panels. Anti-overdrive ridges above and below the nail slots prevent driving nails so tightly as to restrict expansion and contraction. Wider multi-course panels may have a second horizontally-extending, intermediately-located mounting hook on the back for engaging a locking strip.

6 Claims, 10 Drawing Sheets

MOLDED PROTECTIVE EXTERIOR WEATHER-RESISTANT BUILDING PANELS

FIELD OF THE INVENTION

The present invention is in the field of protective, weather-resistant panels for exterior side walls and end walls and sloping roofs of building structures, such as residential, commercial and industrial structures. More particularly, this invention relates to conveniently attachable, self-aligning protective molded exterior building panels configured to look like clapboards, shingles, shakes or slates for installation on side walls, end walls and sloping roofs of buildings and relates to the method of making and installing such exterior weather-resistant panels.

BACKGROUND

There are about fifteen materials which have been used traditionally for exterior protective surfaces on residential and industrial structures. Brick was a leading siding material for many years. Other siding materials have been favored for use in certain geographic regions. For example, stucco primarily has found significant usage for new construction in the southern and western regions of the United States.

Currently, aluminum, hardboard, plywood and vinyl panels have dominated the siding market because of their affordable cost and lower maintenance as compared with brick or stucco. These four materials have been fabricated to simulate the shape and texture of the classic clapboards, wood shakes and shingles that consumers prefer. Slates have also been a classic surface material for residential roofing in some geographical areas, but slate roofing currently is expensive. The shapes and textures of such classic exterior surface materials produce attractive patterns of highlights and shadow lines on walls and roofs as the sun shifts in position during daylight.

Extruded clapboard-pattern vinyl siding has been found to offer a number of advantages over other siding materials. It will not crack, chip or peel. Vinyl, i. e. polyvinyl chloride (PVC), siding never needs painting, as the colorants added during production permeate the siding material. Also, vinyl siding will not rust, dent, rot or host termites or carpenter ants. Vinyl siding is relatively light in weight (comparable in weight to aluminum siding) which makes it easy to handle by the applicator. Because vinyl does not conduct electricity, it does not require electrical grounding.

Extruded clapboard vinyl siding's main disadvantages are caused by a high coefficient of thermal expansion and contraction and by a width limitation of profile extruded vinyl siding, which is limited to about fourteen inches. "Oil canning" caused by temperature changes tends to occur in long lengths of vinyl siding. In order to accommodate thermal expansion and contraction and to achieve the desired protective coverage, an installer will often overlap the vertical edges of vinyl siding, causing noticeable unattractive outward bends in the ends of the overlapping end portions of such siding. Conventional vinyl siding has an unattractive or unnatural softness or "give" to the touch because extruded vinyl areas less than about 0.100 of an inch in thickness are unduly flexible compared with the rigid nature of wood, stone, brick or stucco.

Because of its flexibility, extruded vinyl siding is limited in the width of clapboards which can be simulated.

A ten-inch-wide-face board is not simulated by a conventional vinyl extrusion. Six inches is the widest face board simulated by a vinyl extrusion in my experience. Thus, a vinyl extrusion eight inches wide simulates two four-inch boards, and one ten inches wide simulates two five-inch boards in order to obtain some stiffening effect by a shaping of the vinyl material between the two simulated boards. Against this background, it is noted that in Western regions of the U.S. a ten-inch or a twelve-inch clapboard siding width is popular for home surfaces.

Extruded vinyl siding often has a hand-tooled synthetic-appearing graining which is rolled into the extruded product after a partially congealed (solidified) "skin" has formed on the extruded product, thereby reducing the sharpness of the impressions in this solidified skin. Such a synthetic-appearing graining repeats itself at frequent intervals along the length of the vinyl siding. This frequent repetition is caused by a relatively short circumference around the hardened-steel roller die on which the graining pattern was initially hand-tooled by a die maker.

The prior art production methods of extruding and then roll-forming vinyl siding can only produce lineal shapes of such siding.

SUMMARY

The present invention provides molded exterior weather-resistant panels made of thermoplastic material. For example, panels for simulating one or more courses of clapboards, shingles, shakes or slates may be molded from vinyl so as to retain all of the advantages of vinyl while overcoming or substantially reducing the problems described above, which have been inherent in the prior use of extruded vinyl material for siding.

The molded protective exterior weather-resistant building panels embodying the present invention may be molded using other suitable thermoplastic materials and may be molded as a composite or laminate of two or more thermoplastic materials. Advantageously, such building panels may be molded in any desired length in the range from a few feet u to twenty feet or more, and such building panels may be molded in any desired width up to forty-eight inches or more, as may be desired for various building applications and may be molded to simulate one or more courses of clapboards, shingles, shakes or slates.

As used herein, the term "thermoplastic material" is intended to mean thermoplastic polymer resins and/or thermoplastic copolymer resins which may or may not contain ingredients and/or additives including, but not limited to, colorants, reinforcing particles, reinforcing fibers, reinforcing fabric layers, laminates, surfacing layers, foamants, anti-oxidants, fillers and/or other ingredients and/or additives for enhancing performance of a molded exterior building panel made therefrom. Vinyl (PVC) is a thermoplastic material.

As used herein, the term "rearwardly" or "rearward" means inwardly or inward toward the wall structure or roof structure, as the situation may be. The term "forwardly" or "forward" means outwardly or outward from such building structure.

In accordance with the invention, exterior weather-resistant building panels are provided molded from thermoplastic material. These exterior building panels are attractive in appearance and are adapted to be installed on side walls, end walls and sloping roofs of buildings, including residential, commercial and industrial buildings for protecting building structures from weather. Each such exterior building panel has an upper margin, a lower margin and a main area extending between the upper and lower margin. The upper margin is adapted for attachment to a wall structure or suitably sloping roof structure of a building and is arranged to be overlapped and hidden by a lower margin of a next adjacent higher course of the exterior building panels.

For enabling convenient installation of the next successive higher course of these panels, the top edge of the upper margin of a panel is shaped to provide an upwardly facing groove. For example ,the top edge is positioned a slight distance away from a wall structure or roof structure to which the upper margin of the panel is attached for defining a groove between the top edge and the building structure. Extending along the back of each panel at the juncture of the main area and the lower margin, is a horizontal rib protruding rearwardly (inwardly toward the building structure) and having a downturned lip for providing hooking means engageable into the upwardly facing groove of the next adjacent lower panel.

The installer quickly and easily engages the downturned hooking lip of an exterior building panel embodying the invention into the upwardly facing groove provided by the next adjacent lower course of panels. Thus, the panel being installed becomes aligned with and supported by the next adjacent lower course of panels. Moreover, the hooking engagement between this hooking lip and the groove prevents the lower margin of the panel being installed from moving outwardly, i. e. from being blown away from its hooked position on the building.

After the installer has done this hooking engagement of a panel, the installer then attaches the upper margin of the panel to the building by fasteners, such as nails, being driven through a row of slotted openings extending horizontally along the upper margin. These slotted openings (nailing slots) are elongated in the horizontal direction for accommodating thermal expansion and contraction of the elongated panel in the horizontal direction. For preventing fasteners, such as nails, from being driven so tightly that their heads would prevent longitudinal thermal expansion and contraction of the panel, the row of slotted openings is recessed relative to nearby regions of the upper margin. For example, a pair of parallel, longitudinal ridges extend horizontally along the upper margin. These ridges are positioned above and below the row of slotted openings. These ridges are spaced sufficiently far apart for receiving a nail head between them but not so far apart as to allow a hammer head to enter between them. Thus, the nail head cannot be driven too tightly and will not restrict thermal expansion and contraction of the panel Also, this pair of parallel ridges provides increased lineal stiffness in a building panel.

In an illustrative embodiment of the invention, the main area and lower margin of the exterior building panel are inclined outwardly in a downward direction for simulating a selected configuration of an exterior building surface such as one of the exterior surfaces comprising one or more courses of clapboards, shingles, shakes and slates.

In illustrative embodiments of the invention, the main area and lower margin of the molded panel are stiffened by reinforcing ribbing integrally molded on the back, and the rib providing the hooking lip is integral with such reinforcing ribbing and extends rearwardly beyond such ribbing. The hooking lip is shown spaced rearwardly from the reinforcing ribbing for providing hooking engagement as shown. A second hooking lip may be provided positioned in an intermediate location on the rear of a wider panel designed for representing multiple courses of surface material.

For convenience of description, the illustrative exterior building panels embodying the invention are described as the panels are illustratively shown oriented in an installed position on a vertical wall structure of a building, or on a suitably sloping roof structure of a building with the elongated panel extending horizontally along such building structure. Thus, such horizon-oriented terms as "horizontal", "horizontally", "vertical", "vertically", "upper", "upwardly", "lower", "downward", "downwardly", "top" and "bottom" are not intended as being limiting of the claimed invention but rather such terms are used as easily understood, conveniently descriptive wording relating to an exterior building panel embodying the invention when such a panel is oriented in a position such as it would occupy in installation on a vertical wall structure or sloping roof structure.

BRIEF DESCRIPTION OF THE DRAWINGS

The invention, together with further objects, aspects, advantages and features thereof, will be more clearly understood from a consideration of the following description in conjunction with the accompanying drawings in which the same elements bear the same reference numbers throughout the various FIGURES.

FIG. 3 shows the use of a "starter strip" located at the bottom edge of the wall or roof structure for beginning application of the courses of molded building panels. For purposes of explanation, FIG. 3 shows a hammer head in the action of nailing the upper margin of a third course of the molded panels to the building structure.

FIG. 6 shows a joint between the ends of two adjacent molded panels in the same course. FIG. 6 also shows the use of sheathing between a water-barrier layer and wall studs or roof rafters; whereas FIG. 5 shows a light-weight wall construction arrangement where molded panels are attached to studs without using sheathing between the water-barrier layer and studs.

FIG. 11 also shows a row of spaced slotted openings aligned along the upper margin of a molded panel, with a pair of parallel longitudinal flat-surface ridges extending above and below the nail-slotted area for preventing a nail head from being driven too tightly. Unduly tight nailing is undesired, because over-driving of nail heads would restrict thermal expansion and contraction. Also, this pair of parallel, longitudinal ridges provides increased lineal stiffness to the upper edge of the panel for helping the installer in handling the panel during installation. The functioning of these anti-over-drive ridges is shown in FIG. 4 in cooperation with a hammer head and a nail being driven.

FIG. 20 shows an installation in which a longitudinally extending, horizontal locking strip is used to attach an intermediate region of such a wide building panel to the underlying building structure.

DETAILED DESCRIPTION OF PREFERRED EMBODIMENTS

Figure 1:
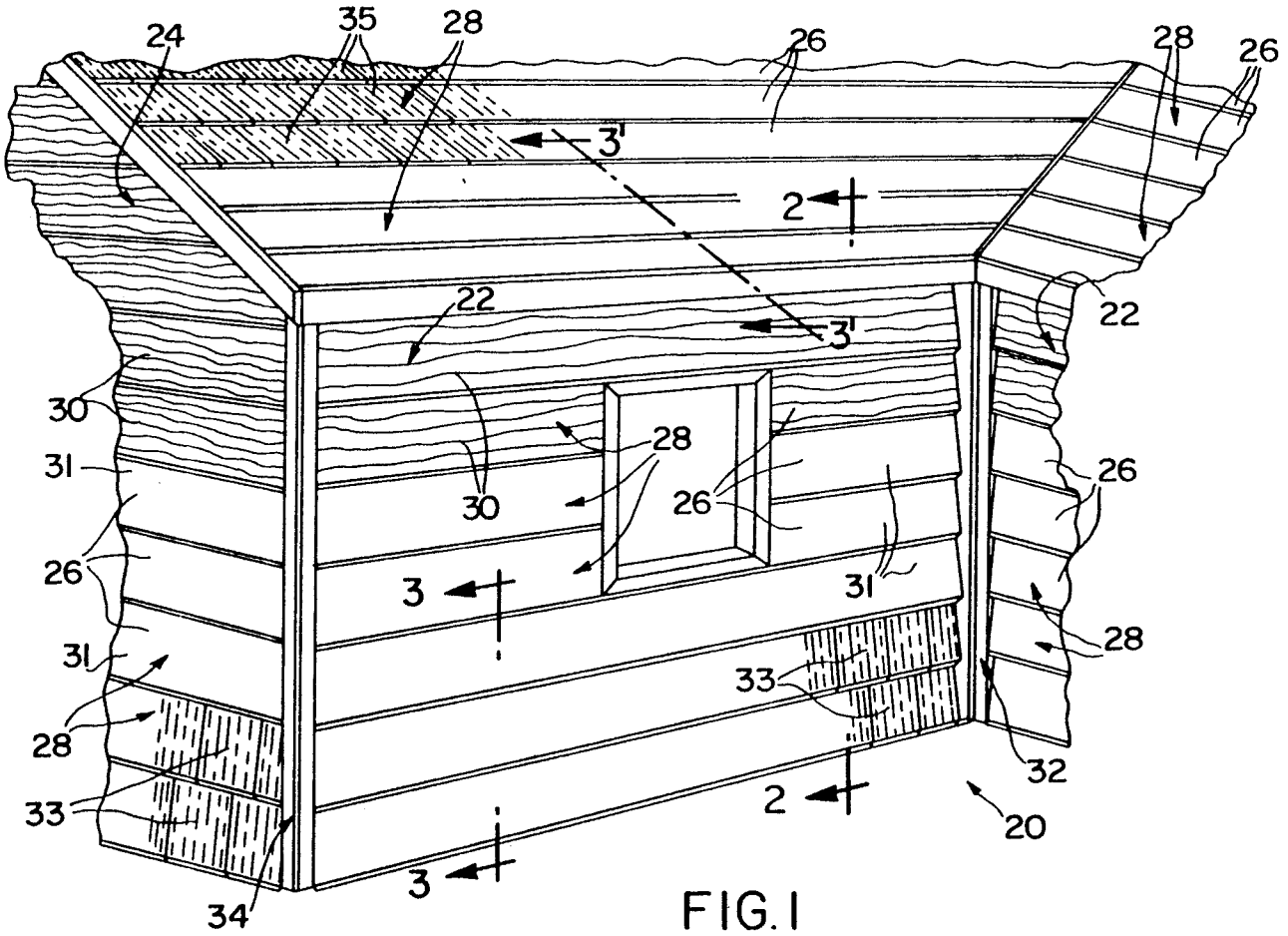
FIG. 1 is a perspective view of an exterior side wall and an exterior end wall and a sloping roof, being shown as portions of a building, such as a house, covered by molded panels embodying the present invention. For purpose of illustration, different styles of panels have been shown on the walls. Upper courses are shown as wood grain textured clapboard surfaces; other courses are shown having smooth clapboard surfaces; and areas of panels on the walls are shaded to indicate shingles or shakes, as the case may be. Also, for purposes of illustration, areas of panels on the roof are shaded to indicate any of shingles, shakes or slates, as the case may be.

In FIG. 1 is shown a building 20 including side walls 22 and an end wall 24, these walls being covered with courses 26 of protective exterior building panels 28 embodying the invention. For illustrating various possible patterns and surface-texture configurations of these panels 28, some of the upper courses 26 on the walls are shown to include panels having a wood grain textured clapboard surface 30, while other courses are shown to have a smooth clapboard surface 31, and also areas of panels on the walls are shaded at 33 to indicate that these panels may have patterns and surface texture configurations to look like shingles or shakes, as the case may be in any particular building installation.

A concave corner of the building between two side walls 22 is covered by a concave vertical trim strip 32. A convex vertical trim strip 34 covers a convex wall corner between end wall 24 and a side wall 22.

The roof as shown is suitably sloping and is covered with courses 26 of protective exterior building panels 28 embodying the present invention. For example, the shading at 35 indicates that these building panels 28 may have patterns and surface texture configurations to look like shingles, shakes or slates, as the case may be, in any particular building installation. It is to be understood that the panels 28 are not designed for installation on a flat roof nor on a gently sloping roof because of weather considerations. A suitably sloping roof has a pitch which is sufficiently steep for enabling the panels 28 to resist intrusion of wind-driven rain. Generally, a roof which is sufficiently pitched for appropriate installation of shingles in a particular geographic area under local weather conditions is suitably sloping for installation of the panels 28.

Figure 2:
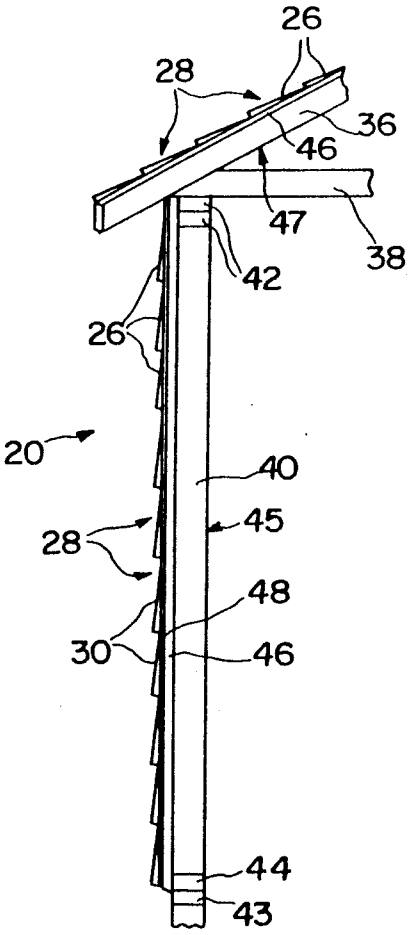
FIG. 2 is an elevational sectional view of the exterior wall and sloping roof of FIG. 1 taken along the line 2—2 of FIG. 1.

Shown in FIG. 2 is a portion of the frame structure of the building 20 comprising a roof rafter 36 , a ceiling joist 38, and a wall stud 40, with horizontal double-top plates 42 and a bottom horizontal plate or "shoe" 44 mounted on a footing or foundation 43. The top and bottom plates 42 and 44 interconnect top and bottom ends of wall studs. Such studs 40 may be made from wood, as indicted in FIGS. 3, 5 and 6, or may be made from aluminum channels or steel channels, or other structural, load-supporting members suitable for use in a wall structure 45. Such roof rafters 36 may be made of wood, as indicated in FIGS. 3 and 6, or may be made from aluminum channels or steel channels, or other structural, load-carrying members suitable for use in a roof structure 47.

Figure 3:
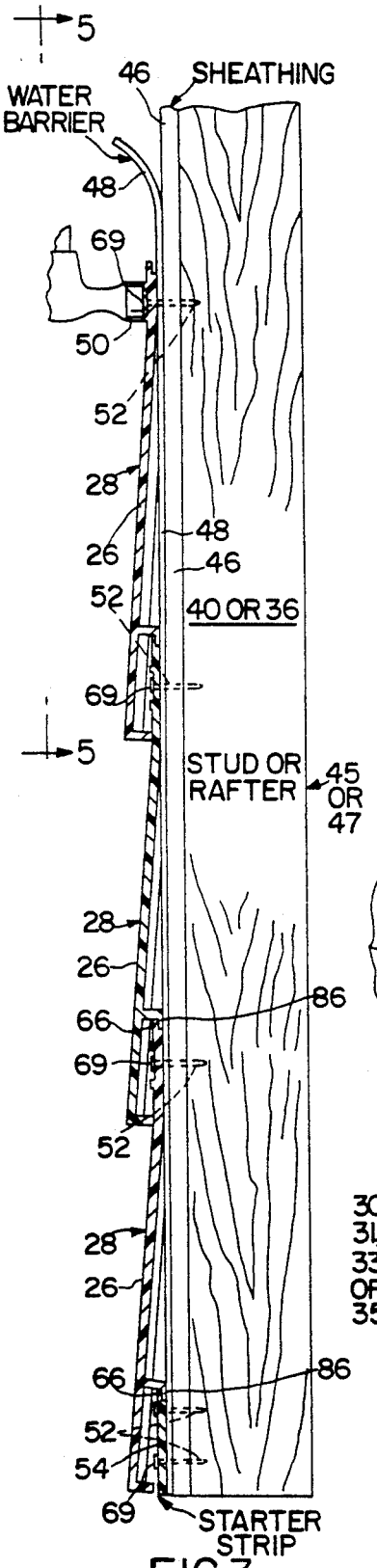
FIG. 3 is an enlarged elevational sectional view of a lower portion of the exterior wall or roof of FIG. 1 taken along the wall line 3—3 or the roof line 3'—3'.
Figure 6:
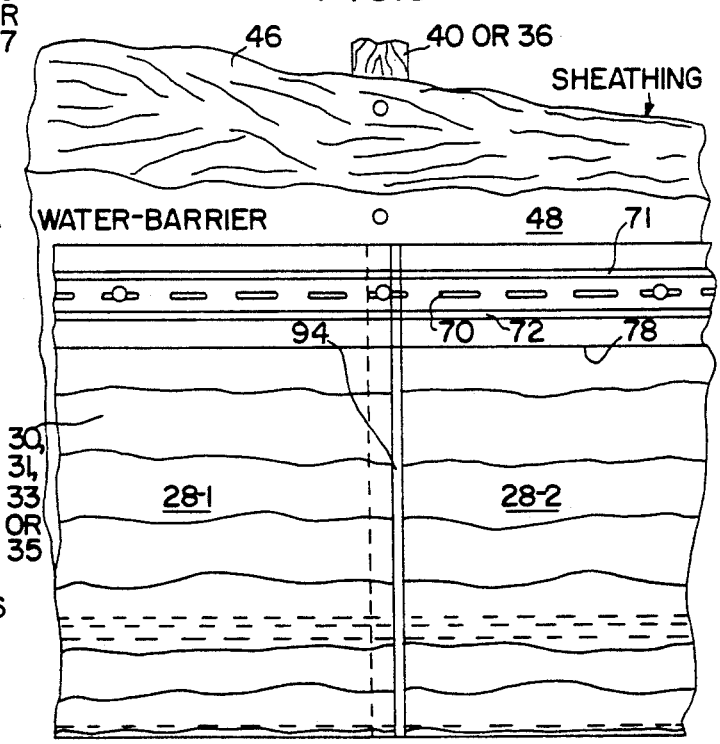
FIG. 6 is a view similar to FIG. 5, except that a textured surface is indicated on the molded building panels. Also.

In FIGS. 2, 3 and 6, the wall structure 45 and roof structure 47 are shown as including a sheathing layer 46, for example a layer of plywood or particleboard, or a similar suitable stiff structural layer. This sheathing layer 46 is shown secured to studs 40 and to the top plates 42 and to the bottom plate 44. In the roof structure 47 this sheathing layer 46 is shown secured to rafters 36. Over the sheathing layer 46 is a moisture-permeable water-barrier sheet layer 48, for example, comprised of asphalt-impregnated building felt paper or of "TYVEK" (brand) housewrap material commercially available from du Pont Corporation, or the like. The building panels 28 are fastened to the sheathing layer 46 and/or fastened to the wall studs 40 or to the roof rafters 36.

The panels 28 are arranged in horizontally extending courses 26 with lower margins of panels in a next adjacent higher course in hook engagement with and overlapping and covering upper margins of panels below them.

In FIG. 3 a hammer head 50 is shown driving a nail fastener 52 for fastening an upper margin of a third-course panel 28 to a building structure. In this illustrative example, the nail 52 passes through water-barrier and sheathing layers 48, 46, respectively, into a stud 40 or into a roof rafter 36. Other nail fasteners 52 are shown similarly attaching upper margins of second and first courses of the panels to the building structure 45 or 47. The courses of siding panels are installed on a wall structure 45 or on a roof structure 47 by starting at the bottom edge of the wall or roof and then by progressing upwardly fastening each successive higher course. In order to start installing the lowermost (first) course 26, a starter strip 54 (FIG. 3) is first fastened to the wall or roof structure 45 or 47, for example. by using nail fasteners 52. Then, the lower margin of the lowermost panel 28 is aligned with and is held in place by hooking engagement with this starter strip 54, as will be explained in detail later.

Figure 4:
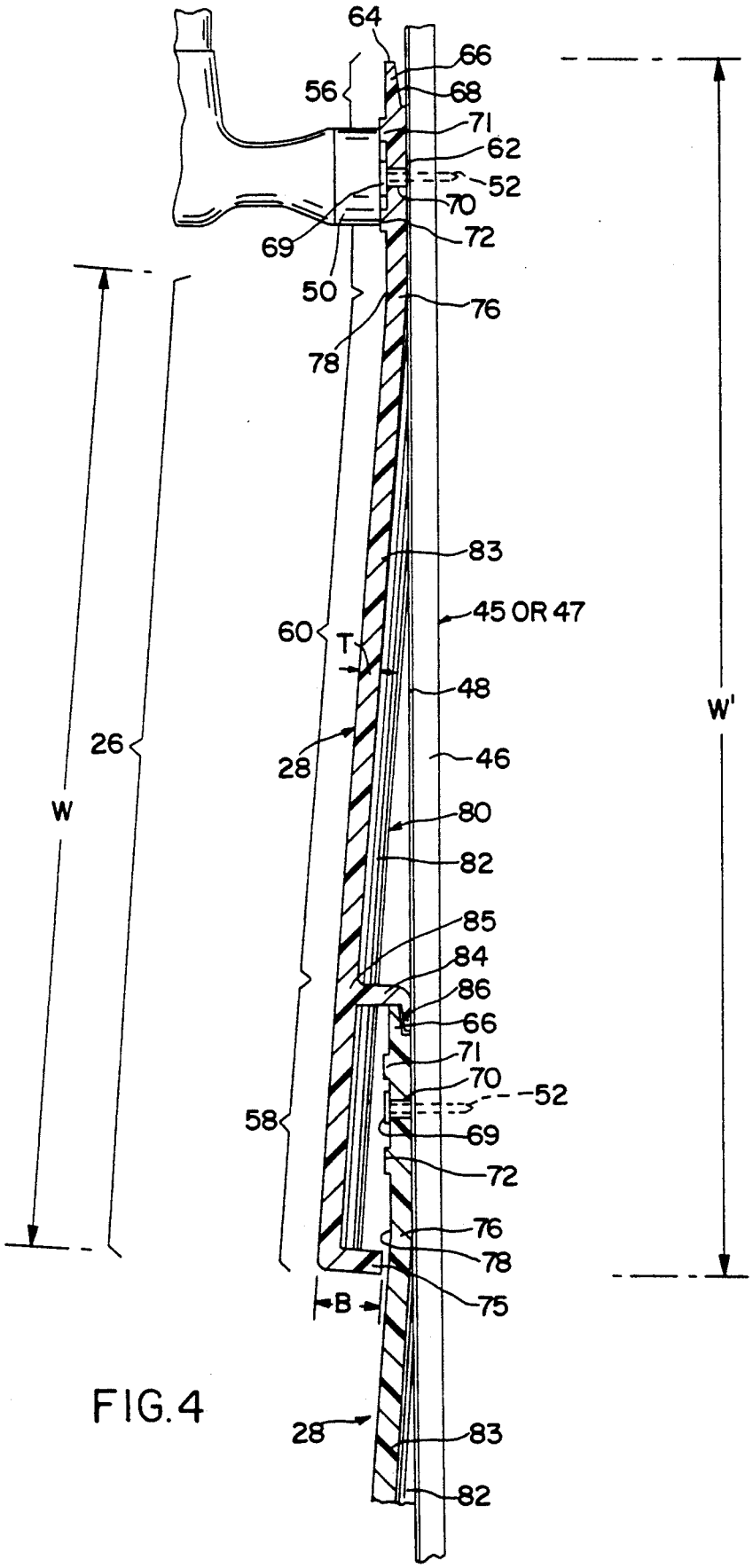
FIG. 4 is a further enlargement of an upper portion of FIG. 3 for illustrating in detail features of the invention. The nail slot area is recessed about one-sixteenth of an inch for preventing nailing too tightly, for avoidance of undesired restriction of thermal expansion and contraction.
Figure 7:
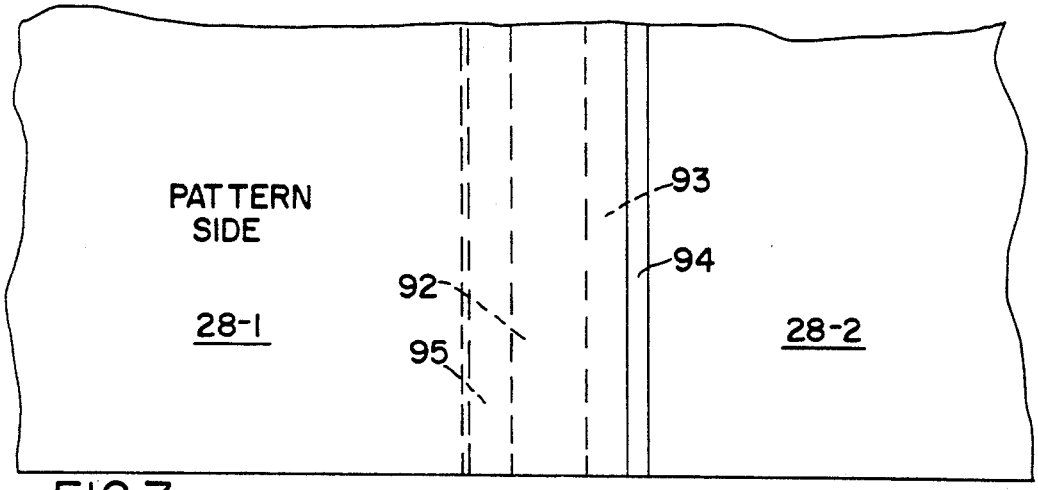
FIG. 7 is an enlarged elevational view of a portion of a lap joint between the ends of two building panels.
Figure 8:
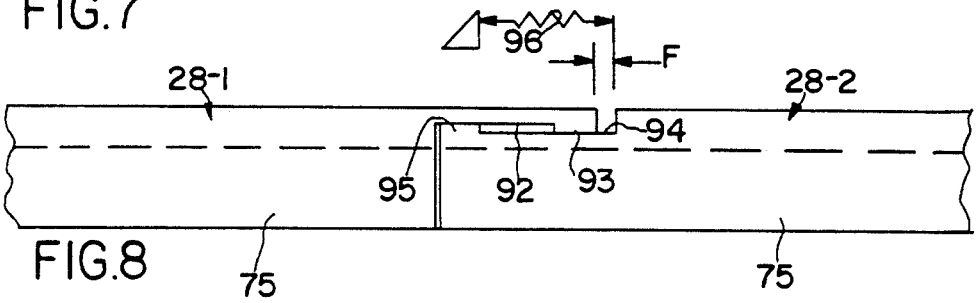
FIG. 8 is a view of this lap joint as seen from the bottom looking upwardly in FIG. 7.
Figure 9:
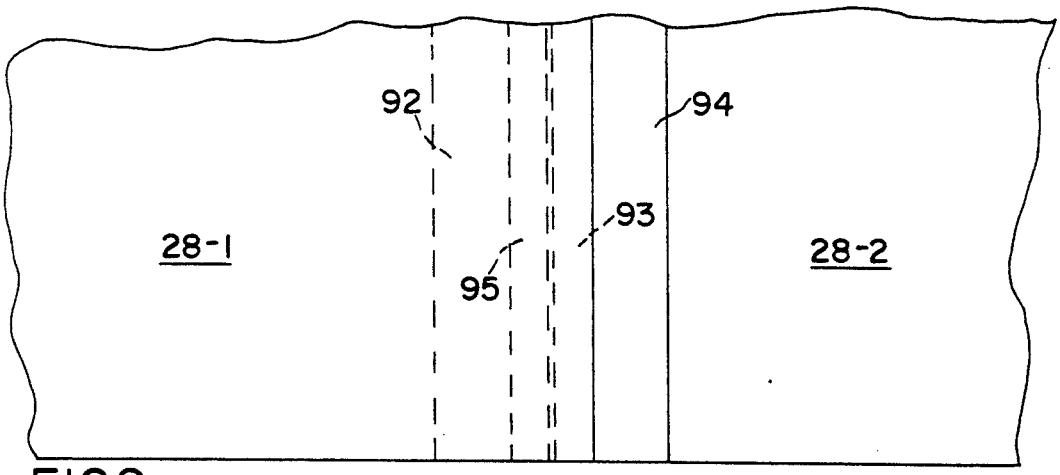
FIG. 9 is an enlarged elevational view similar to FIG. 7 illustrating ability of the joint to accommodate dimensional changes in the molded building panels due to thermal expansion or contraction.
Figure 10:
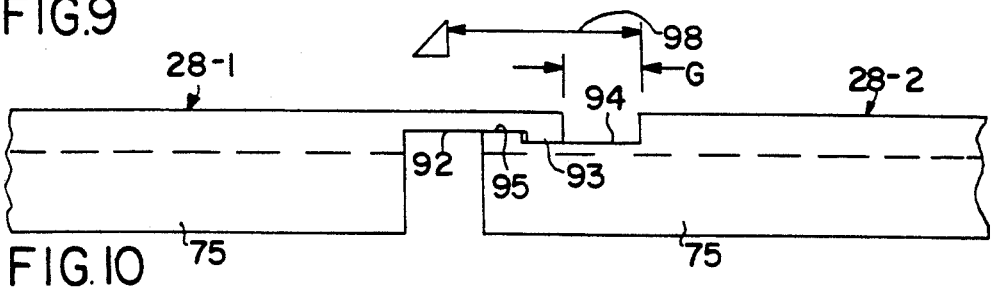
FIG. 10 is a view of the lap joint as seen from the bottom looking upwardly in FIG. 9.
Figure 11:
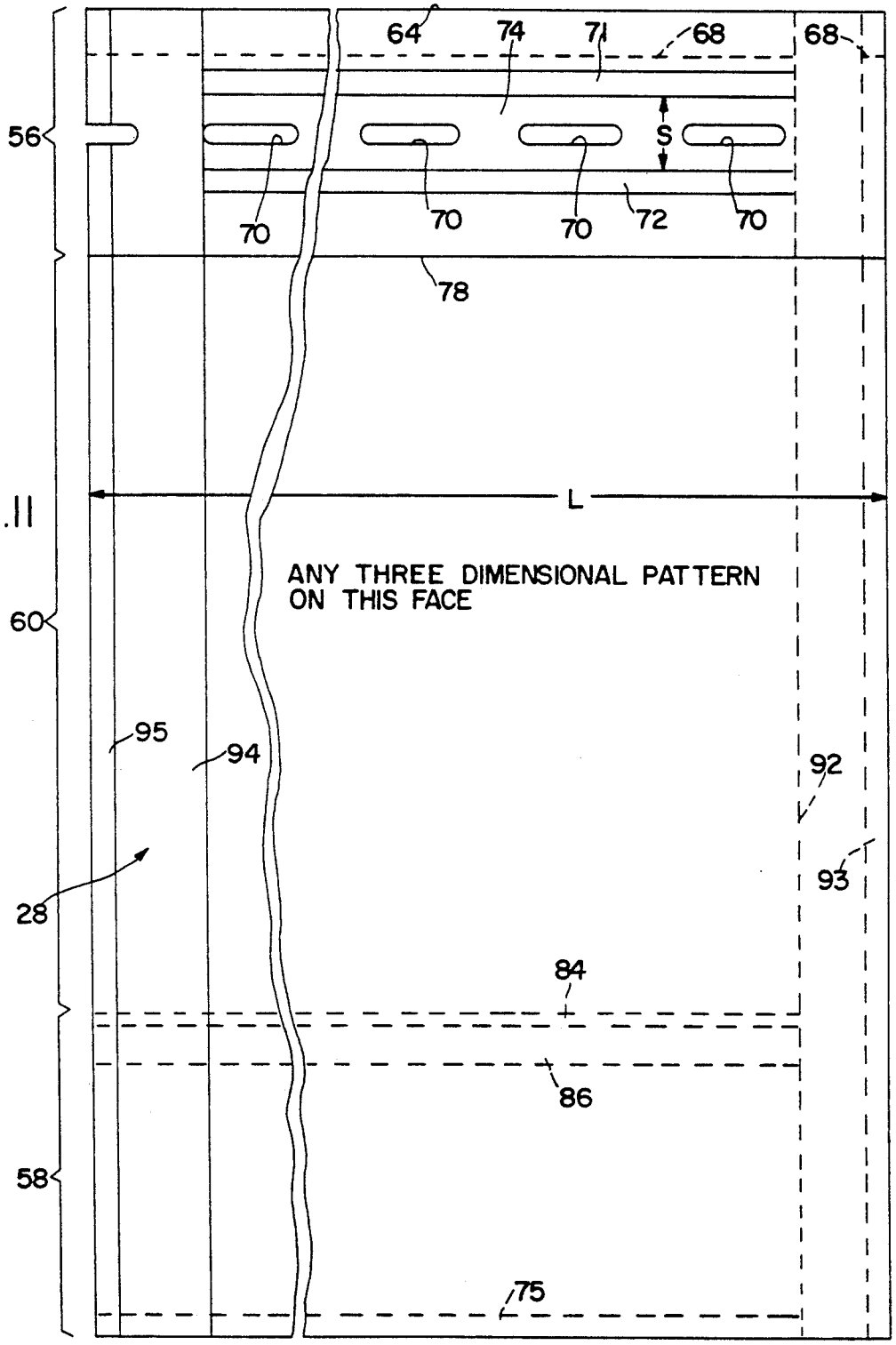
FIG. 11 is an enlarged elevational view of the front of a molded building panel embodying the invention, indicating that any desired three-dimensional pattern may be imprinted on the front surface, for example, patterns selected from the group comprising clapboards, shingles, shakes and slates.
Figure 12:
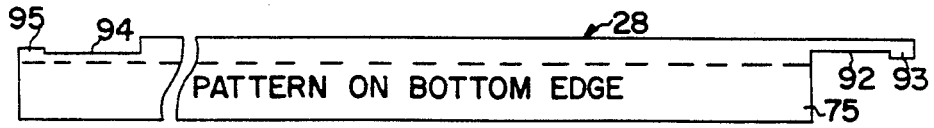
FIG. 12 is a view of the inturned bottom edge of the panel of FIG. 11 indicating that any desired three-dimensional pattern may be molded on this bottom edge.

Inviting attention to FIGS. 4, 11 and 12, an exterior building panel 28 molded from thermoplastic material and embodying the invention comprises: an upper margin 56, which may also be called a "nailing strip", a lower margin 58, and a main median area 60 extending between the upper and lower margins. Such a panel 28 may have any desired width (including the upper and lower margins 56 and 58, together with the median area 60) in a range up to forty-eight inches, or even more, depending upon the number of courses of surface material represented by the panel and depending upon the width of each course being represented, as will be explained later. Such panels 28 may have any desired suitable horizontal length "L" (FIG. 11), for example, being 6, 8, 10, 12, 14, 16, 18 or 20 feet in length or more or less. The upper margin 56 is shown having a flat back side 62 (FIG. 4) for facing toward and fastening against a wall or roof structure 45 or 47, respectively, as the case may be.. Extending along the top edge 64 of the upper margin 56 is an upwardly projecting lip 66 which is spaced forwardly from the back side 62 for defining an upwardly-facing, horizontally-extending mounting groove (or "slot") 68 which is adapted to be used for hooking-action attachment of a lower margin of a next upper panel, as explained in detail later. It is noted that the inside (rear) surface of the lip 66 slopes rearwardly in a downward direction for providing a rearward camming (wedging) action during such hooking engagement of a next higher panel.

Figure 13:
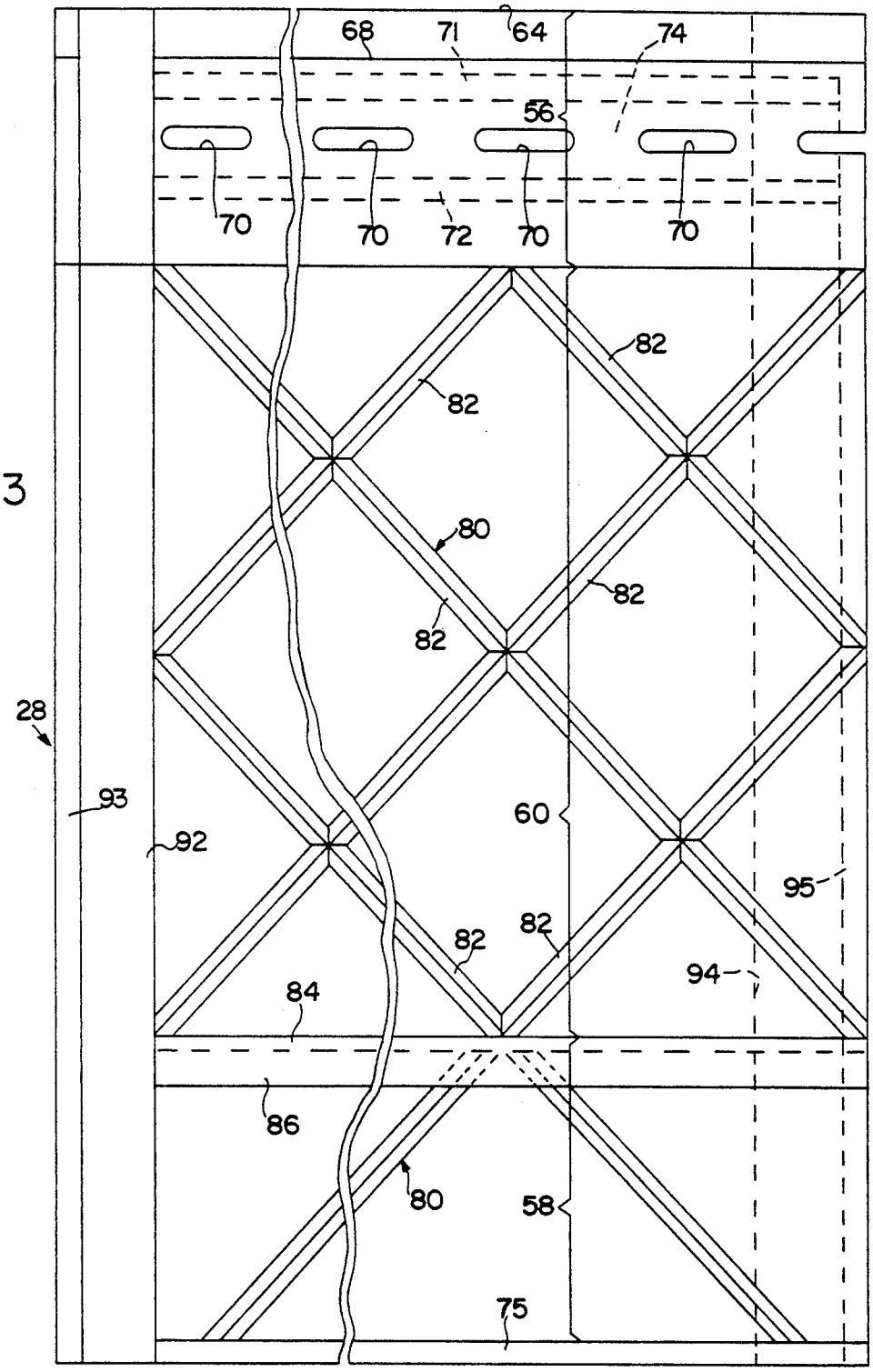
FIG. 13 is an elevational view of the back surface of the molded siding panel of FIG. 11 for illustrating a square or diamond "waffle" pattern of integral diagonal reinforcing ribbing for strengthening the surface area of this panel.

In order to attach the upper margin ("nailing strip") 56 of a panel 28 to a wall or roof structure 45 or 47, there is at least one row of mounting apertures 70 (FIG. 11), which may be called "nailing slots", spaced downwardly from the upper edge 64 and extending horizontally. In the molded exterior building panel embodiment of the invention shown in FIGS. 4, 11 and 13, this row of mounting apertures 70 extends horizontally along the centerline of the upper margin 56.

Figure 5:
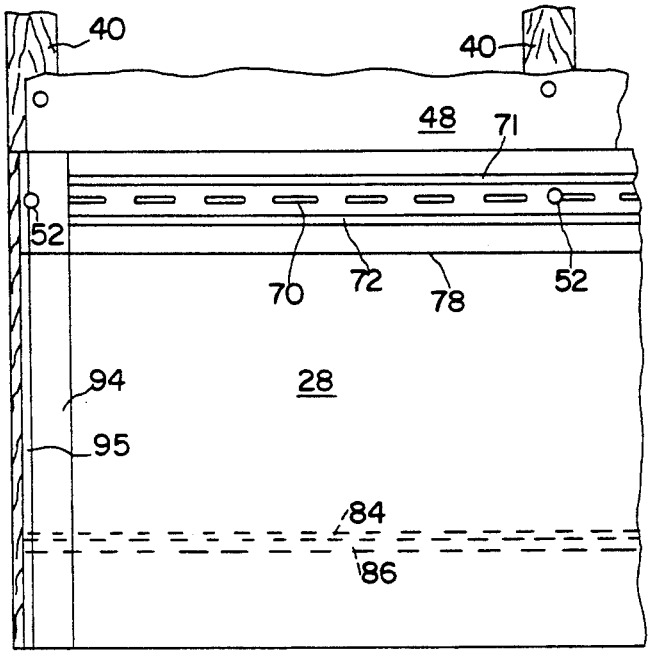
FIG. 5 is a front elevational view, as seen from the position 5—5 in FIG. 3, showing a portion of a molded building panel and showing broken away portions of the underlying structure of the building.

For accommodating thermal expansion and contraction of the horizontally-elongated panels 28, these mounting apertures (slots) 70 have a vertical width wider than the shank of a nail fastener but narrower than a nail head. For example, the vertical width of these nailing slots 70 is in a range from about 5/32nds to about 7/32nds of an inch, and they are horizontally elongated, for example having a horizontal length in a range from about 0.6 of an inch to about 2.5 inches, depending upon the panel length L (FIG. 11). The longer the panel length, the longer these nailing slots are preferred to be for accommodating thermal expansion and contraction. These nailing slots are shown spaced about one-half to three-quarters of an inch apart. In a presently preferred embodiment, these nailing slots 70 have a vertical width of about 3/16ths of an inch, and they have a length of about one inch for a panel having a length up to about ten feet. Such one-inch long nailing slots are shown spaced apart by a spacing of about ½ inch, because wall studs 40 or roof rafters 36 often have a horizontal width of about 1.5 inches. For panels longer than ten feet up to about twenty feet, the length of these nailing slots is preferred to be in the range of about 1.5 to about 2.5 inches. These presently preferred dimensions provide an installer with facility for driving fasteners 52 through appropriately selected apertures 70 into the studs 40, as shown in FIGS. 3, 5 and 6 or into rafters 36, as shown in FIGS. 3 and 6.

In these illustrative examples, the nail fasteners 52 are shown having relatively large diameter flat heads 69, sometimes being called "roofing nails". For assuring that the elongated mounting apertures 70 will accommodate horizontal thermal expansion and contraction, anti-over-drive means are provided for preventing the nail heads 69 from being driven so tightly that they would grip or crimp the perimeters of the apertures, thereby preventing expansion and contraction. Such anti-over-drive means as shown comprises recessing the nail-slot region 74 (FIG. 11) by an amount slightly more than the thickness of the flat heads on nails 52.

This recessing of the nail-slot region 74 is shown being provided by two flat-surfaced ridges 71 and 72 positioned above and below the nail-slot region. These parallel ridges are located respectively equal distances above and below the row of apertures 70. As shown in FIG. 4, these longitudinally extending ridges 71 and 72 are about 1/16th of an inch in front-to-back extent and are sufficiently widely spaced "S" (FIG. 11) for receiving the flat head 69 of a "roofing nail" 52 between them, but they are sufficiently closely spaced for preventing a hammer head 50 from entering between them. For example, this spacing "S" is in the range from about ⅝ths to ¾ths of an inch. Consequently, there advantageously remains a slight clearance between the head 69 of a driven nail fastener 52 and the nail slot region 74 beneath the nail head. Each nail head thereby becomes driven into substantially the same closely spaced relationship with respect to the nail slot region 74 between ridges 71 and 72 for firmly holding the back side 62 of the upper margin against the wall or roof structure 45 or 47 with sufficient clearance remaining beneath the nail head for allowing thermal expansion and contraction to occur for the length L of the whole panel 28.

The vertical width of the upper margin 56 as seen in FIG. 11 may be in a preferred range of about 1¾ of an inch to about 3½ of an inch and may be in a more preferred range from about 2 inches to about 3 inches, for example being about 2½ inches in vertical width. The vertical width of the lower margin 58 as seen in FIG. 11 is sufficient for providing attractive and weather protective coverage when installed over the upper margin of a next lower panel, as shown in FIG. 4. Thus the width of the lower margin 58 is preferred to be slightly greater than the width of the upper margin 56 for providing the desired overlapping coverage over the upper margin of an adjacent lower panel.

The lower margin 58 terminates at the bottom in an inturned bottom edge 75 forming a rear flange which extends rearwardly a sufficient distance "B" (FIG. 4) for substantially reaching the front face of the adjacent lower panel for simulating wood clapboards, shingles, shakes or slates as may be desired. For example, the bottom dimension "B" is in a preferred range from about ½ inch to about 1½ inches and is more preferred to be in the range of about ⅝ inch to about 1⅛ inches, for example being about 0.71 of an inch for simulating a wood clapboard, shingle, shake or slate product having a butt thickness of about ¾ths of an inch.

In FIG. 4 is shown a panel 28 for simulating one course 26 of surface material, and the main median area 60 and the lower margin 58 are shown generally coplanar, extending downwardly and inclined outwardly relative to the flat back side 62 of the upper margin. For example, the average downward outward inclination of the course 26 defined by the main median area 60 and of the lower margin 58 relative to the back side 62 is shown in a preferred range from about 3 degrees to about 7 degrees. In FIG. 4, this downward outward inclination of the course 26 is shown as being a more preferred value in a range of about 4 degrees to about 5 degrees.

The main median area 60 and the upper margin 56 are joined along a horizontal juncture region 76 located adjacent to a line of inflection 78 at the upper limit of the downward outward slope of the main median area 60.

The desired width of the lower margin 58 for providing protective overlapping coverage of an adjacent upper margin was previously described. In order to simulate clapboards, shingles, shakes or slates, the vertical width of the main median area 60 added to the vertical width of the lower margin 58 may be equal to an overall amount "W" (FIG. 4) comparable with typical exposure to weather of one course 26 (See also FIGS. 1, 2 and 3) of wood clapboards or of wood shingles or of shakes or of slates, as the case may be, depending upon a desired simulation and in accord with surface textural configurations and patterns 30, 31, 33 or 35 (FIGS. 1 and 6). For example, in a situation as shown in FIGS. 3 and 4 where each panel 28 represents a single course 26 of surface material, then "W" may be in a preferred range from about 6 inches to about 14 inches and may be in a more preferred range from about 7 inches to about 12 inches, depending upon the exposure to weather of the course 26 of the natural wood or slate product being attractively simulated by building panels 28. Thus, the overall width W' (FIG. 4) of the whole panel 28 including its upper margin 56 may be in a range of about 7¾ inches to about 17½ inches depending upon the exposure to weather with W and depending upon the width of the upper margin. It is again noted that this panel 28 in FIG. 4 is shown as designed to simulate a single course 26 (FIGS. 1, 2 and 3) of clapboards, shingles, shakes or slates.

Figure 14:
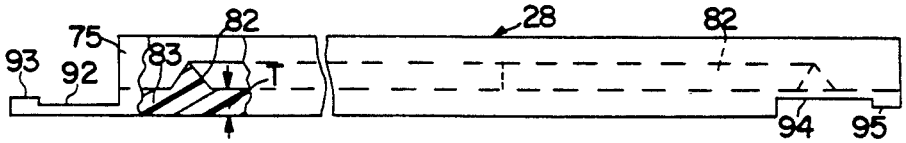
FIG. 14 is a view of the bottom edge of the molded panel of FIG. 13, showing a portion of the panel surface and an integrally formed reinforcing rib in section, illustrating a triangular sectional shape for such ribbing.

In order to stiffen the main median area 60 and lower margin 58, an integral reinforcing ribbing 80 (FIG. 13) is shown molded on the back of the panel 28. For example, this ribbing 80 may have a repetitive diamond square or waffle pattern, wherein each diamond is shown as having a diagonal corner-to-corner dimension in a preferred range of about 2 inches to 4 inches, depending upon the thickness and inherent stiffness of the thermoplastic material, and in accord with desired product characteristics of the main median area 60 and lower margin 58. This integral ribbing 80 as shown comprises diagonal ridges 82 each having a triangular cross-sectional shape, as seen in FIG. 14.

As seen most clearly in FIG. 4 and in FIGS. 14 through 17, the entire face region 83 of a panel 28 is shown as having a thickness "T" in a preferred range from about 5/32nds of an inch to about ⅜ths of an inch, for example being about ¼th of an inch.

Figure 15:
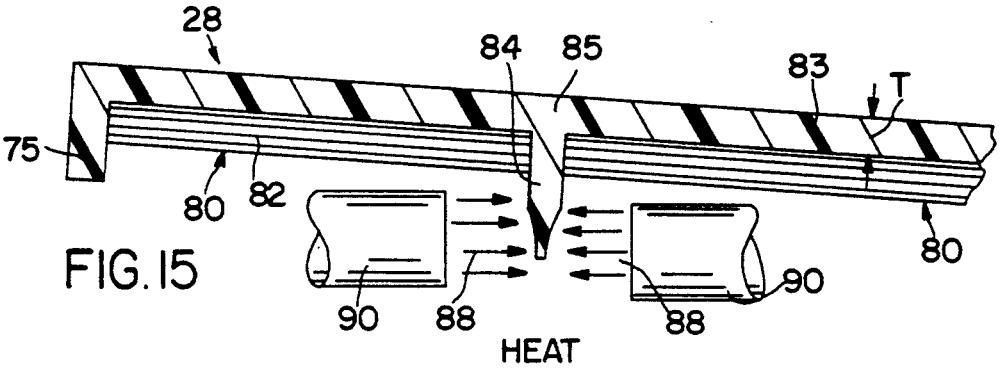
FIGS. 15, 16 and 17 are views showing progressive steps in the formation of a down-turned hook-action mounting lip on the inner edge of a rear ledge extending longitudinally along the back surface of a building panel embodying the invention and formed of thermoplastic material.
Figure 16:
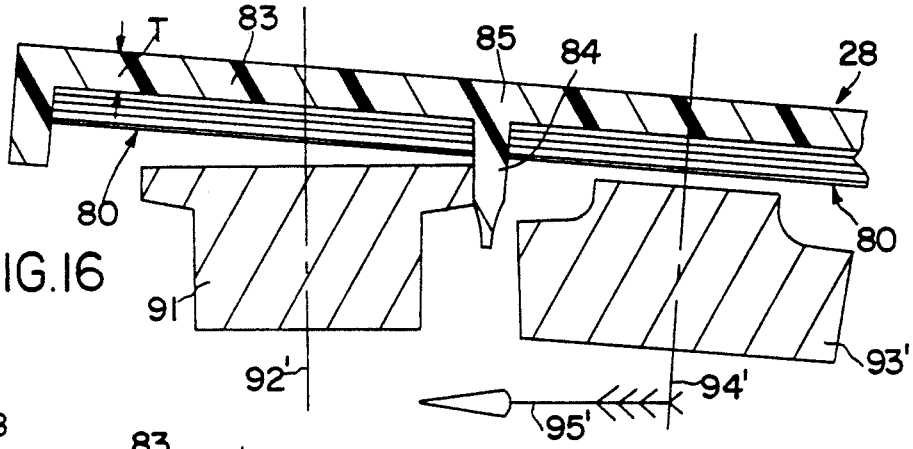

In order to provide hooking and aligning and weight supporting engagement with an upwardly projecting horizontally extending lip 66 on a next lower panel, as shown in FIG. 4, there is a molded rearwardly projecting horizontally extending leg strip 84 (most clearly seen in FIGS. 15 and 16). This leg strip 84 is integrally molded generally perpendicular with the face region 83 and is integral with the reinforcing ribbing 80. This leg strip 84 is located at the juncture 85 of the main area 60 and the lower margin 58.

A process which may be used for molding thermoplastic material into panels 28 is disclosed in U.S. Pat. No. 4,290,248 in which the present inventor is one of the two joint inventors.

It is preferred that the thermoplastic material be foamed during the molding process for producing panels 28 having a density in a preferred range of about 0.7 to about 0.4 of the density of the thermoplastic material prior to such foaming. The panels 28 as shown have a density in a more preferred range of about 0.6 to about 0.45. Among the advantages of such foaming are to reduce weight and cost and to provide an enhanced thermal insulation effect after installation on a wall structure 45 or roof structure 47. Moreover, by virtue of such foaming, a given mass (quantity measured by weight) of the thermoplastic material produces a panel 28 having considerable thicker (dimension "T") overall surface region 83, thereby advantageously increasing panel rigidity as compared with a panel of the same length and width molded from an equal mass of unfoamed thermoplastic material. The ribbing 80 further stiffens the panel 28 and increases its rigidity.

In the molding process disclosed in said U.S. Pat. No. 4,290,248, a mold of 25 feet or more in circumference may produce continuous lengths of panel product with no repetition in surface pattern and texture 30 for at least 25 feet. Then, building panels 28 of discrete length "L", for example 8, 10, 12, 14 or 16 feet or more are cut from the continuous molded product having a repeating pattern every 25 feet, thereby producing panels 28 that are rarely identical in surface texture and configuration, as compared with prior art extruded and then rolled vinyl siding that shows the same pattern repeated two to six times on each commercial length of siding.

Figure 17:
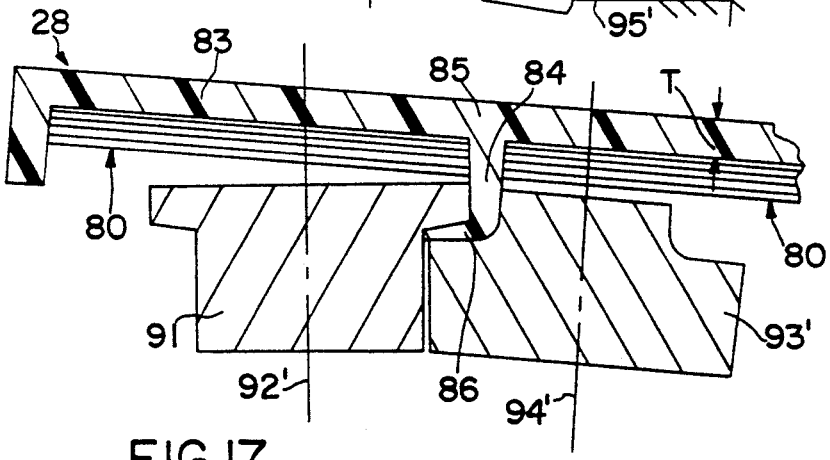

Subsequent to molding of the whole panel 28, the rear edge portion of the leg strip 84 is bent down and set at about a right angle relative to the unbent portion for forming a hooking flange or lip 86. Such bending down and setting of the hooking flange or lip 86 on the leg strip 84 is accomplished by first heating this leg 84 by impinging jets 88 (FIG. 15) of hot air fed through nozzles 90 aimed at the rear edge portion of this leg. Next, the heated edge portion of this leg 84 is introduced, as shown in FIG. 16, between a flanged anvil roll 91 rotatable around an axis 92' and a forming roll 93' rotatable about an axis 94'. Then, the axis 94' of this forming roll is moved as shown by arrow 95' toward the anvil roll axis 92' for initiating forming of hook means 84, 86. This hooking flange 86 is then roll-formed to provide substantially right-angle hook means 84, 86, as shown in FIG. 17. Following such roll-forming of the hooking flange or lip 86, it is retained in its substantially right-angle bent state and is cooled by shape retention and cooling means (not shown), for example such as a cooling shoe.

In order to provide for neat convenient lap joint installation of panels 28, the rear surface of each panel 28 is routed as seen in FIGS. 12 and 14 parallel to one cut end (for example, along the right end of each panel) to provide a vertically extending rear channel 92, for example, having a horizontal width of about 1 inch for a panel length L up to ten feet or a width of about 1½ inches for a panel length over ten feet up to sixteen feet or a width of about 2 inches for a panel length from sixteen to twenty feet, depending upon the type of thermoplastic material from which the panel is made and its coefficient of thermal expansion and contraction, and having a depth of about ⅛th of an inch, with an adjacent vertically extending parallel rear lip 93. The front surface of each panel 28 is similarly routed (for example, the left end of each panel) to provide a front channel 94 having a comparable width and depth with a vertically extending parallel front lip 95. This routing of the channels 92 and 94 and their parallel lips 93 and 95 is accomplished at the same time that the continuous molded product is being cut into discrete panel lengths "L", as was discussed above.

In FIGS. 7, 8, 9 and 10 are shown enlargements of portions of the lap joint illustrated in FIG. 6 for illustrating accommodation to thermal expansion and contraction. For convenience of reference, the respective panels 28 on the left and right are indicted by 28-1 and 28-2. In accommodating thermal expansion, the amount of overlap increases, as shown by a zigzag arrow 96, and only a relatively narrow portion "F" of the routed front channel 94 is visible. As a result of thermal contraction, the overlap decreases, as shown by a straight arrow 98, and a wider portion "G" of front channel 94 becomes visible. Thus, regardless of expansion or contraction, a neat joint is provided and the underlying wall or roof structure is protected from weather.

Figure 18:
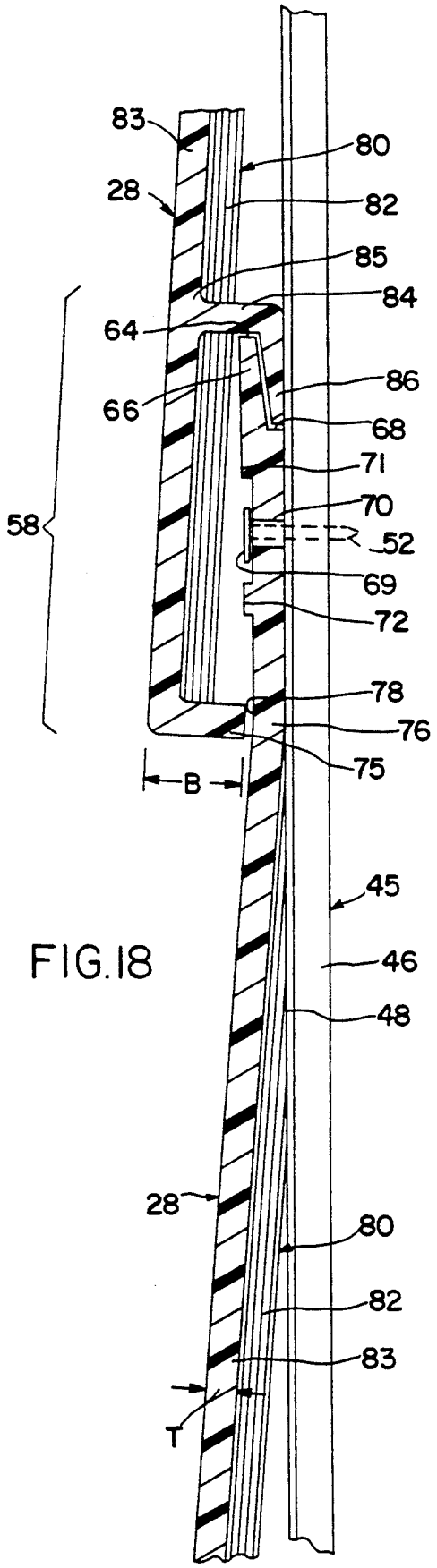
FIG. 18 is a drawing similar to FIG. 4 for illustrating an alternative embodiment of the invention in which a larger hook-engageable lip on the upper edge of a building panel is flush with the front of the upper anti-over-drive ridge for providing a more positive hooking engagement with a larger hooking lip on the next panel.

In an alternative embodiment shown in FIG. 18, the upwardly projecting lip 66 along the top edge 64 is made relatively larger in vertical extent and in thickness than in FIG. 4 by being molded flush with and integral with the upper anti-over-drive ridge 71. The upwardly-facing, horizontally-extending groove or slot 68 is also made relatively larger in vertical extent and larger in front-toback width By virtue of these increases in size, the hooking flange or lip 86 on the rear leg strip 84 can be made larger in vertical extent and in thickness for providing a more positive hooking action, i.e. there is an increased firmness of the hooking engagement over and behind the upwardly projecting lip 66. As explained previously, the inside (rear) surface of lip 66 slopes rearwardly in a downward direction for providing a rearward camming (wedging ) action on the hooking flange or lip 86 of the next higher panel. The relatively large vertical extent of this hooking flange 86 provides a strong wedging action behind the lip 66. Except for these described modifications in the top edge 64, ridge 71 and lip 66, groove 68, leg strip 84 and hooking flange 86, the panel embodiment 28 of FIG. 18 may otherwise be similar to the panels 28 previously described.

Method of Installing

During installation of any embodiment of the panels 28 on a wall structure 45, or on a roof structure 47, a starter strip 54 is fastened along a lower portion of the wall or roof where a hooking flange or lip 86 on a first or lowermost panel is to be located A snap-line horizontal chalk line or other suitable level marking on the wall or roof structure may be used to assure that the starter strip is level (horizontal). This starter strip has an upper lip 66 (FIG. 3) and rear groove adapted for engagement with a hooking flange or lip 86 of the lowest panel 28. By virtue of this hooking engagement, the lowest panel 28 automatically becomes aligned horizontally with the starter strip 54 in the desired level position for installation of this first panel. Moreover, this hooking engagement advantageously supports the weight of the lowest panel 28, thereby freeing the installer's two hands for accurately positioning and driving fastener nails 52 through the selected nailing slots 70 in the upper margin of this first panel. In other words, the installer does not need help from another person or from temporary supports or temporary attachments in order to keep holding the lowest panel in true level position while driving the fastening nails for permanently fastening its upper margin to the wall or roof structure.

As soon as fastening of the upper margin of the lowest course of the panels to the wall or roof structure has been completed, each next higher overlying panel is placed in hooking engagement with an upper lip of an adjacent lowest panel, thereby again automatically achieving an aligned level position for the second course of panels. The upper margins of these next higher panels are fastened to the wall or roof structure after being hooked in position, and then overlying panels for the third course of panels are hooked into position and their upper margins are fastened to the wall or roof, and so forth, as the installer proceeds by hooking into alignment and supporting the overlying panel of each successive higher course and then fastens its upper margin.

This hooking engagement method of automatically achieving self-levelling alignment and weight support for installation of each successive higher course of panels facilitates speedy and accurate installation of panels covering a wall or roof, thereby using less time and less labor steps and assures that each course is self-levelled in alignment with the horizontal starter strip. In summary, if the starter strip is fastened level, all of the courses of panels will then become level by their advantageous self-levelling hooked engagement with the successive underlying courses.

If an installer happens to lack enough starter strips 54 and has a surplus of panels 28 at hand, additionally needed "starter strips" can quickly and very satisfactorily be made on the site by using a circular saw to cut off upper margins 56 from unused panels A convenient place to guide the cutting blade is along the zone between the lower ridge 72 and the inflection line 78.

Wider Building Panels Simulating More Than One Course of Surface Material

Figure 19:
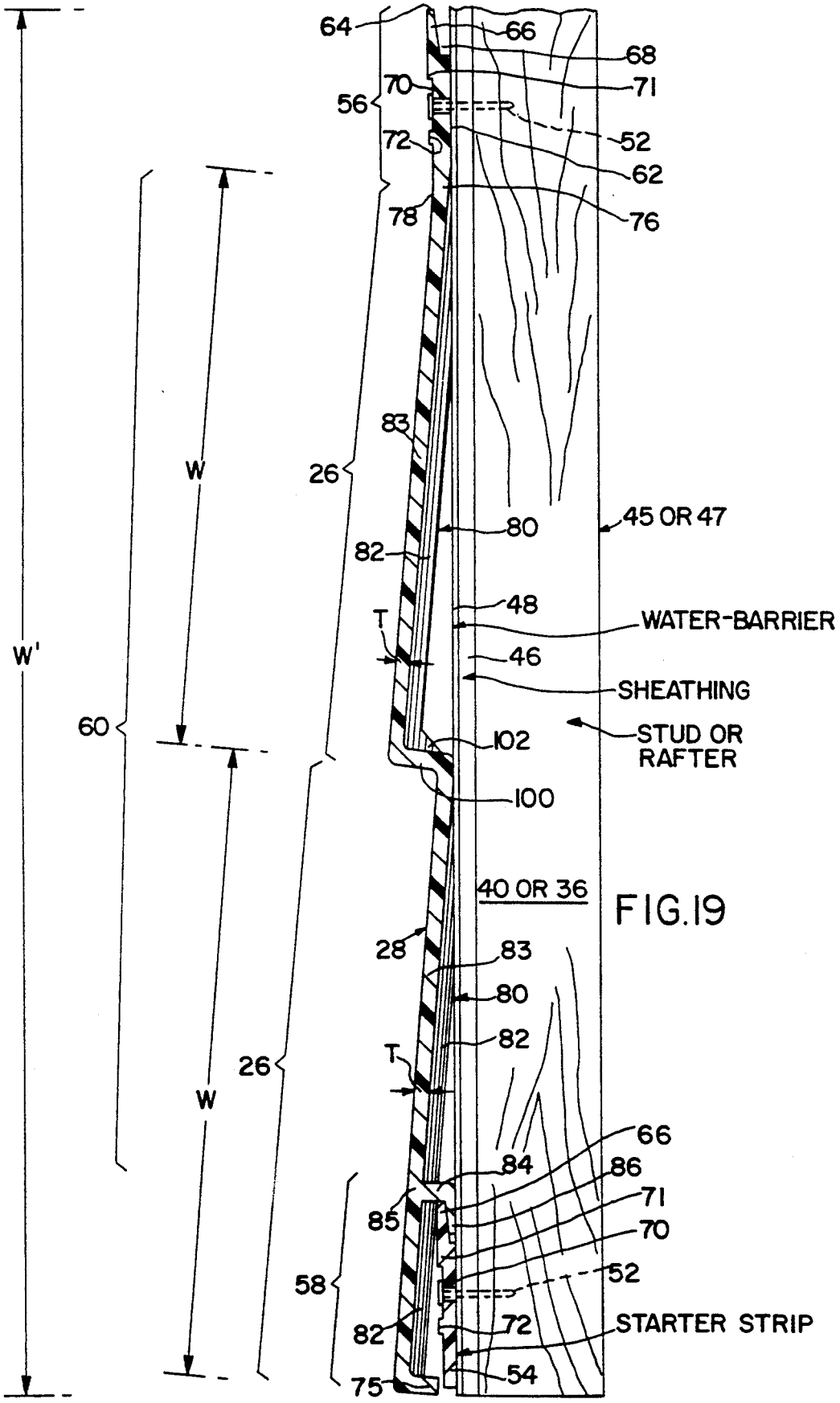
FIG. 19 is an enlarged view similar to the lower portion of FIG. 3 for illustrating an alternative embodiment of the invention in which a wider building panel is molded for attractively simulating two courses of such products as clapboards, shingles, shakes or slates, as the case may be.
Figure 20:
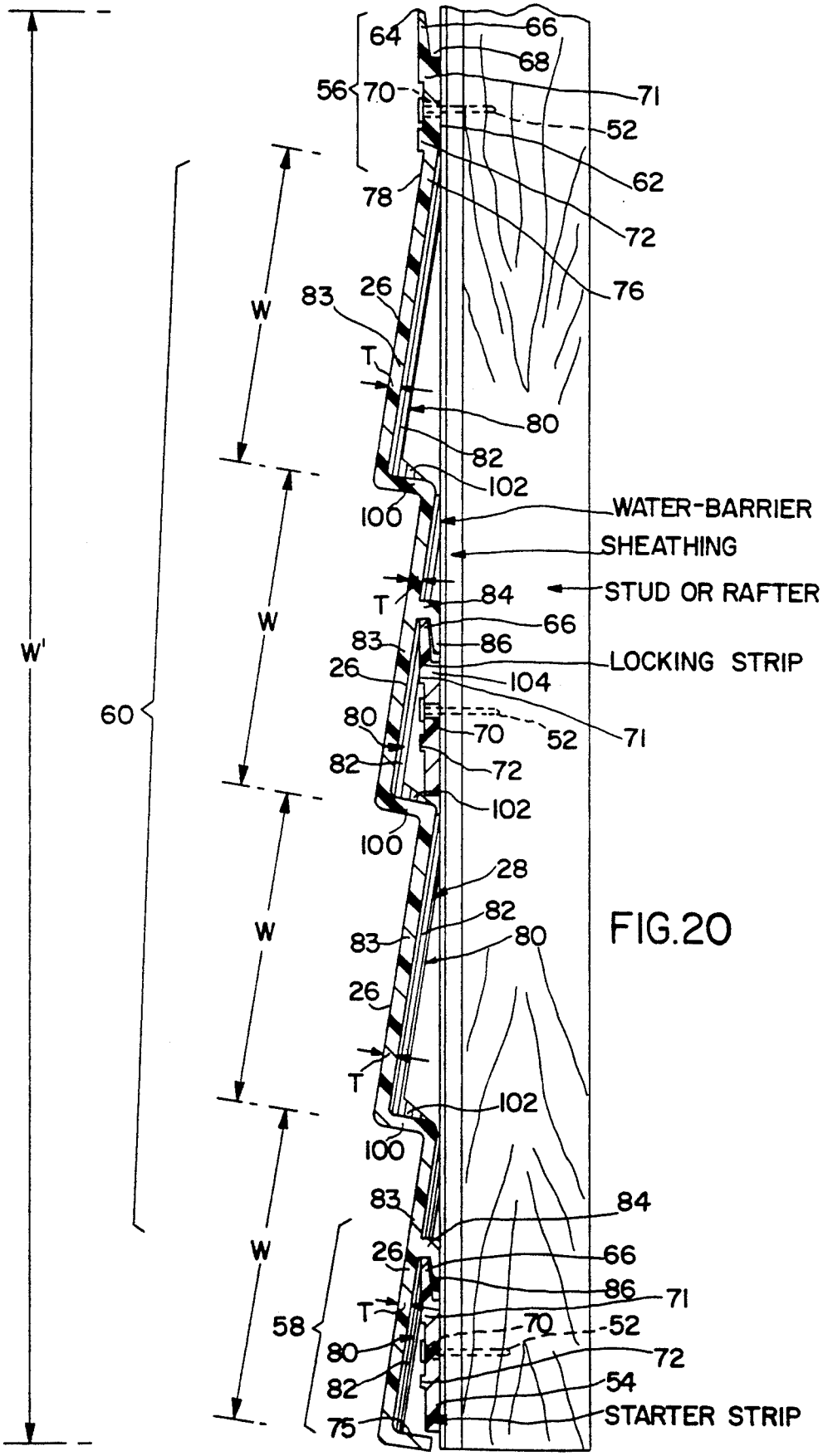
FIG. 20 is a drawing similar to FIG. 19 for illustrating an alternative embodiment of the invention in which a considerably widened building panel is molded to simulate four courses of such products. Also.

In FIGS. 19 and 20 are shown wider exterior building panels 28 for advantageously simulating multiple courses 26 of a classic surfacing material, for example such as clapboards, shingles, shakes or slates. The panel 28 in FIG. 19 represents or simulates two courses 26 each of width "W", and the panel 28 in FIG. 20 represents four courses 26 each of width W. Between each of the courses 26 the face region 83 of the panel is inturned at 100 for simulating or representing a butt of the respective contiguous course above such inturn 100. The reinforcing ribbing 80 is shown including gussets 102 integral with the respective ribs 82 and integral with the inturned butt regions 100. The rearwardly facing portions of the ribs 82 immediately below the inturned butt regions 100 (and also immediately below the upper margin 56 in all embodiments of panels 28 as shown) are flattened for providing flat rib surfaces facing toward and adapted to rest flush against a building structure 45 or 47.

In the illustrative two-course embodiment of the panel 28 shown in FIG. 19, the width "W" of each course 26 exposed to weather may be in a preferred range from about 6 inches to about 14 inches, compared with six inches being the widest face board in my experience simulated by a vinyl extrusion, as was explained in the BACKGROUND. The width W of each course 26 may be in a more preferred range from about 7 inches to about 12 inches.

The overall panel width "W" in FIG. 19 includes the width of the upper margin 56 as shown, which may have a width in a preferred range from about 1¾inches to about 3½ inches or in a more preferred range from about 2 inches to about 3 inches. Consequently, the overall panel width W' may be in a range from about fourteen inches to about thirty inches.

Selecting twenty-four inches as being a convenient illustrative overall building panel width W' for such a two-course exterior building panel 28, as shown in FIG. 19, and selecting 2½. inches as being a convenient illustrative width for the upper margin 56, it is seen that each of the two courses 26 has an attractive exposed face width W of about 10¾ inches. This exposed face width of about 10¾ inches advantageously lies near the middle of the 10 to 12 inch board face width which is popular for home surfaces in Western regions of the U.S., as noted in the BACKGROUND.

For illustrative purposes, a starter strip 54 is shown with the two-courses panel 28 in FIG. 19. It is to be understood that the next higher two-course panel above the one shown in FIG. 19 will not require a starter strip, because its hook-flange 84, 86 will be engaged with and will be aligned on the building structure 45 or 47 by the groove and lip 68, 66 on the upper margin 56 of the panel seen in FIG. 19. In other words, these two-course panels are installed on a building structure 45 or 47 using the same convenient advantageous "METHOD OF INSTALLING" previously described for the single-course panels 28.

With the illustrative embodiment of the exterior building panel 28 in FIG. 20, comprising four courses 26, there is shown a locking strip 104 in addition to the starter strip 54. This locking strip is secured to the building structure 45 or 47 by suitable fasteners 52. The four-course panel 28 includes an intermediate rearwardly projecting integral ledge strip 84 with a downturned hooking flange or lip 86 which may be produced as explained in connection with FIGS. 15–17. This ledge strip and downturned lip 84, 86 is located in an intermediate region of the panel 28, for example being on the rear of the second course 26 down from the upper margin. This lip 86 is hooked behind the upwardly projecting lip 66 on the locking strip 104. This locking strip 104 may be identical with the starter strip 54. Each of them may include anti-over-drive ridges 71 and 72 as shown located above and below nail slots 70.

In the illustrative four-course embodiment of the exterior building panel 28, shown in FIG. 20, the width "W" of each course 26 exposed to weather may be in a preferred range from about 6 inches to about 14 inches. This width W of each course 26 may be in a more preferred range from about 7 inches to about 12 inches. The overall panel width "W'" in FIG. 19, includes the width of the upper margin 56, as shown, which may have a width as discussed above regarding the two-course panel 28 shown in FIG. 19. Consequently, the overall panel width W' may be in a range from about twenty-four to about sixty inches.

Selecting forty-eight inches as being a convenient illustrative overall building panel width W' for such a four-course exterior building panel as shown in FIG. 20, and selecting 2½ inches as being a convenient illustrative width for the upper margin 56, it is seen that each of the four courses 26 has an attractive exposed face width of about 11⅜ inches. This exposed face width of about 11⅜ inches advantageously lies near the middle of the 10 to 12 inch board face width popular for surfacing Western homes.

For illustrative purposes, a starter strip 54 is shown with the four-course panel 28 in FIG. 20. It is to be understood that the next higher four-course panel above the one shown in FIG. 20 will not require a starter strip, because its lower hook-flange 84, 86 will be engaged with and will be aligned on the building structure 45 or 47 by engaging the groove and lip 68, 66 on the upper margin of the panel shown in FIG. 19. The convenient, advantageous method of installing wider panels 28 with a locking strip 104 as shown in FIG. 20 will now be described.

Method of Installing Wider Panels With Intermediate Locking Strips

The method of installing wider exterior building panels such as shown in FIG. 20 utilizing intermediate locking strips 104 is generally similar to the method of installing single or multiple course panels 28 without locking strips, and proceeds as explained below.

During installation a starter strip 54 and a locking strip are both fastened along a lower portion of a wall structure 45 or a roof structure 47 where the respective lower hooking flange 84, 86 and intermediate hooking flange 84, 86 are each to be engaged in hooked relationship on the building. Snap-line horizontal chalk lines or other suitable level markings on the wall or roof structure may be used to assure that both the starter strip 54 and locking strip 104 are level and are suitably spaced one above the other for receiving the lowermost (initial) panel 28 in simultaneous hooking engagement with both attaching strips 54 and 104. By virtue of this hooking engagement the lowermost (initial or first) panel 28 automatically becomes aligned on the building in the desired level position. Further, this hooking engagement advantageously supports the weight of the lowest multiple-course panel, thus freeing both of the installer's hands for accurately placing and driving fastener nails 52 through the selected nailing slots 70 in the upper margin of this lowermost panel. No assistant nor temporary support is needed for temporarily holding the lowermost panel level in its desired location while its upper margin is being fastened to the building.

As soon as fastening of the upper margin 56 of the lowermost panel has been accomplished by driving suitable fasteners 52, such as roofing nails, then, another chalk line or suitable marking is put on the building structure 45 or 47 at the appropriate level at a predetermined spacing above the top edge 64 of the lowermost panel for location of the second locking strip 104. This second locking strip is fastened to the building structure 45 or 47 along this line or marking by suitable fasteners 52 driven into the building through nail slots 70 in the locking strip.

Next, the second multi-course panel 28 is applied to the building structure by hooking engagement of the respective lower hooking flange 84, 86 with the lip and groove 66, 68 of the already-attached lowermost panel and simultaneously by engagement of the respective intermediate hooking flange 84, 86 with the already-fastened second locking strip 104, thereby automatically achieving an aligned level position for this second multi-course panel. Next, the upper margin 56 of this second multi-course panel is fastened to the building by suitable fasteners 52 driven into the building through the nail slots 70 in the upper margin.

Then, a third locking strip is fastened to the building along an appropriately placed level chalk-line or other suitable level marking at a predetermined spacing above the top edge 64 of the now-secured second panel. Next, a third panel is hooked into engagement with this third locking strip and with the upper lip and groove 66, 68 of the now-secured second panel, thereby again automatically achieving an aligned level position for this third multi-course panel. Then, its upper margin is fastened to the building.

In this manner the installer proceeds upwardly along the building structure 45 or 47 installing these multi-course panels employing the locking strips 104. An additional increment of time is involved in fastening the respective locking strips 104 to a building structure for attaching a wide multi-course building panel 28, as shown in FIG. 20, employing such locking strips compared with the time involved for installing a narrower single-course or multi-course building panel 28, as shown in FIG. 4 or 19, wherein no locking strips are employed. This additional increment of time is compensated for by the fact that these wide multi-course panels provide a relatively large area of building coverage as each such panel is installed on the building, and they have the advantage of providing relatively fewer horizontal joints between panels for a given area of building coverage.

It is understood that the exemplary molded exterior building panels described herein and shown in the drawings represent only presently preferred embodiments of the invention. Indeed, various modifications and additions may be made to such embodiments without departing from the spirit and scope of the invention. For example, various reinforcing ribbing arrangements or other reinforcing may be provided. Various exterior building surfacing products other than clapboards, shingles, shakes and slates may be simulated and various arrangements of courses of such other surfacing products may be simulated. Thus, these and other modifications and additions may be apparent to those skilled in the art and may be implemented to adapt the present invention for installation on a variety of buildings and for use in a variety of climates and in different geographic regions without departing from the spirit and scope of the invention as claimed in the following claims.

I claim:

1. An exterior weather-resistant building panel molded from thermoplastic material, said exterior building panel comprising:

an upper margin, a lower margin and a main area extending between said upper and lower margins, said building panel having a length of at least six feet, said building panel having a front for facing to weather and a back, said upper margin having a back side for placing against a building structure during attachment of the upper margin to the building structure, said upper margin being adapted for overlapping by a lower margin of a next adjacent higher one of said building panels fastened to the building structure, said upper margin having a top edge, said lower margin having a bottom edge, said top edge being positioned forwardly from said back side for spacing said top edge away from a building structure to which the upper margin is fastened, said building panel having first and second ends, said building panel having thereon integral therewith a rearwardly projecting strip, said rearwardly projecting strip extending horizontally along said building panel substantially all of said length between said first and second ends of the building panel, said rearwardly projecting strip being spaced above said bottom edge of the building panel, said rearwardly projecting strip having thereon a horizontally extending downturned rear edge forming horizontally extending continuous hook means on the back of said lower margin, said continuous hook means extending continuously along said rearwardly projecting strip, said continuous hook means being for continuous hooking engagement on the top edge of a next adjacent lower one of said building panels fastened to the building structure for supporting the panel and for aligning the panel with a next adjacent lower building panel, said continuous hook means being sufficiently spaced above said bottom edge of the building panel for said hook means in such hooking engagement to hold said lower margin in an installed position with said lower margin overlying an upper margin of a next adjacent lower building panel, said main area being shaped in a plurality of courses, said building panel having thereon integral therewith a second rearwardly projecting strip spaced above the rearwardly projecting strip, said second rearwardly projecting strip being rearward of an intermediate course and extending horizontally along sad building panel parallel with the rearwardly projecting strip, and said second rearwardly projecting strip having thereon a horizontally extending downturned rear edge forming second horizontally extending hook means.

2. An exterior weather-resistant building panel as claimed in claim 1, in which:

said main area is shaped in at least three courses, and said second rearwardly projecting strip extends horizontally along the back of said main area of the building panel rearward of an intermediate one of said courses.

3. An exterior weather-resistant building panel molded from foamed thermoplastic material, said exterior building panel comprising:

an upper margin, a lower margin and a main area extending between said upper and lower margins, said building panel having a length of at least six feet, said building panel having a front for facing to weather and a back, said upper margin having a back side for placing against a building structure for attachment of the upper margin to the building structure, said upper margin being adapted to be overlapped by a lower margin of a next adjacent higher one of said building panels fastened to the building structure, said upper margin having a top edge, said lower margin having a bottom edge, said top edge being positioned forwardly from said back side for spacing said top edge away from a building structure to which the upper margin is fastened, said building panel having first and second ends, said building panel having thereon integral therewith a rearwardly projecting strip, said rearwardly projecting strip extending horizontally along said building panel substantially all of said length between said first and second ends of the building panel, said rearwardly projecting strip being spaced above said bottom edge of the building panel, said rearwardly projecting strip having thereon a horizontally extending downturned rear lip forming horizontally extending continuous hook means extending continuously along said rearwardly projecting strip, said continuous hook means providing for continuous hook engagement on the top edge of a next adjacent lower one of said building panels fastened to the building structure for supporting the panel and for aligning the panel with a next adjacent lower building panel, said continuous hook means being spaced above said bottom edge of the building panel for said hook means in such hooking engagement to hold said lower margin in an installed position overlying an upper margin of a next adjacent lower building panel, said upper margin having a row of mounting apertures spaced downwardly from said top edge, said row of mounting apertures extending along said upper margin, said apertures being arranged for accommodating thermal expansion and contraction of said building panel, a first ridge on the front of said upper margin positioned above said row of apertures and extending horizontally continuously along said upper margin, a second ridge on the front of said upper margin positioned below said row of mounting apertures and extending horizontally continuously along said upper margin, said first and second ridges being positioned substantially symmetrically above and below said row of apertures, said first and second ridges being sufficiently far apart for receiving between them nail heads of nails inserted through said apertures, said first and second ridges being sufficiently close together for preventing entry between them of a hammer head for preventing a nail head from being tightly driven against said upper margin for allowing thermal expansion and contraction of said building panel, said top edge being an upwardly projecting lip integral with and projecting upwardly from said first ridge, said upwardly projecting lip having a rear surface sloping rearwardly in a downward direction for providing a rearward camming action on hooking means of a next adjacent higher building panel for wedging the hooking means of a next adjacent higher building panel toward a building structure, and said lower margin of said building panel being arranged for overlying a first and second ridge, row of mounting apertures and nails inserted through said apertures of a next lower building panel fastened to the building structure when the building panel is in said installed position.

4. An exterior weather-resistant building panel molded from foamed thermoplastic material according to claim 3, in which:

said main area has a thickness "T" in a range from about 5/32nds of an inch to about ⅜ths of an inch, and said foamed thermoplastic material has a density in a range of about 0.7 to about 0.4 of the density of the thermoplastic material prior to foaming for being comparable with densities of wood products and for providing thermal insulation.

5. An exterior weather-resistant building panel molded from foamed thermoplastic material according to claim 3, in which:

said main area is shaped in at least two courses, said building panel has thereon integral therewith a second rearwardly projecting strip spaced above the rearwardly projecting strip, said second rearwardly projecting strip extending horizontally along said building panel parallel with the rearwardly projecting strip, and said second rearwardly projecting strip having thereon a horizontally extending downturned rear lip forming second horizontally extending hook means.

6. An exterior weather-resistant building panel molded from foamed thermoplastic material according to claim 3, in which:

said main area is shaped in at least two courses, and each of said courses has a vertical width "W" in a range from about 6 inches to about 14 inches.

* * * * *